US008115121B2

(12) United States Patent
Chu et al.

(10) Patent No.: US 8,115,121 B2
(45) Date of Patent: Feb. 14, 2012

(54) TIMER SWITCH

(75) Inventors: Ming-Teng Chu, Hsinchu (TW); Shih-Chi Chan, Hsinchu (TW)

(73) Assignee: Norm Pacific Automation Corp., Hsinchu (TW)

( * ) Notice: Subject to any disclaimer, the term of this patent is extended or adjusted under 35 U.S.C. 154(b) by 233 days.

(21) Appl. No.: 12/696,360

(22) Filed: Jan. 29, 2010

(65) Prior Publication Data

US 2011/0186412 A1 Aug. 4, 2011

(51) Int. Cl.
*H01H 7/08* (2006.01)

(52) U.S. Cl. ..... 200/38 R

(58) Field of Classification Search ..... 200/38 R, 200/38 B, 37 A

See application file for complete search history.

(56) References Cited

U.S. PATENT DOCUMENTS 5,637,843 A * 6/1997 Joyce et al. ..... 200/38 R
6,441,326 B1 8/2002 Amonett
6,483,052 B2 * 11/2002 Joyce et al. ..... 200/38 R
6,613,991 B1 9/2003 Amonett et al.
6,797,897 B2 9/2004 Amonett et al.
6,838,626 B2 1/2005 Deylitz et al.
7,005,589 B2 * 2/2006 Amonett et al. ..... 200/38 F

* cited by examiner

*Primary Examiner* — Edwin A. Leon
*Assistant Examiner* — Vanessa Girardi
(74) *Attorney, Agent, or Firm* — Morris Manning & Martin LLP; Tim Tingkang Xia, Esq.

(57) ABSTRACT

A timer includes a case, a shaft, a cam wheel, a drive mechanism, and a plurality of switch blades disposed within the case. The shaft is rotatably and reciprocally movably disposed in the case. The cam wheel is pivoted on the shaft and rotates together with the shaft when setting, or rotates independently by the drive mechanism. The cam wheel includes a plurality of cam tracks on one side surface thereof and a plurality of ratchets and grooves on a circular rim thereof. The drive mechanism contacts the ratchets to drive the cam wheel to rotate relative to the shaft. The switch blades respectively contact the cam tracks of the cam wheel, and correspondingly generate an electrical connection/disconnection. When the shaft moves to the setting position and the cam wheel being rotated by the user, a flexible element touches the grooves formed on the circular rim results a tactile feedback.

9 Claims, 14 Drawing Sheets

TIMER SWITCH

BACKGROUND OF THE INVENTION

1. Field of the Invention

The present invention relates to a timer, and more particularly to a mechanical timer applicable to timer-operated household electrical appliances.

2. Related Art

Currently, commercially-available washing machines are mainly classified into two types, namely, microcomputer type and mechanical type. Taking a mechanical washing machine as an example, the time course is set by turning a knob, so as to start washing, rinsing, drying, and other functions at a particular time. For example, U.S. Pat. Nos. 6,441,326, 6,613,991, 6,797,897, 6,838,626 and 7,005,589 disclose a timer with a front housing and a rear housing. Contained within the front housing and rear housing are a timing motor and gear train assembly to drive a main cam. The main cam has geometry to be contacted by cam followers of switch arms. As the main cam rotates, the varying contours of program cam surfaces move the switch arms between neutral and offset positions. The movement of the switch arms relative to one another results in the activation and deactivation of electrical circuits which operate the cycles of the appliance to which the timer is associated. The timer includes a setting feedback (SF) system. By this SF system, cam followers are lifted off the program cam surfaces so that a "V"-shaped follower remains in contact with a custom feel profile on the side of the main cam proximal the front housing. This "V"-shaped follower acts as a tactile and/or audible feedback member, by engaging the textured surface of the custom feel profile to impart such tactile feel to the user during rotation of the main cam.

The timer has a shaft extending outside the housing for user to operate. Typically, the shaft has two operation positions along its axis, namely a setting position where the main cam surface and the cam follower of switch arms are lifted off; and a driving position where the main cam surface and the cam follower of switch arms contact. At the setting position, the main cam can be rotated by the user to an appropriate angular position to begin a timing cycle. At the driving position, the timing motor starts to drive the main cam. Usually, the timer shaft is pressed down to the setting position, and pulled up to the driving position.

There are some drawbacks in the aforesaid prior art timers. Firstly, since the switch arms are raised by an actuator beam mounted on the shaft, and the switch arms are all on one side of the cam, the force on the actuator is unbalanced that easily bends the beam. Secondly, the timer gear train requires a clutch mechanism which allows manual rotation of the main cam only in a forward direction in order to prevent any rotation of the cam in a reverse direction that will damage the timer components during manual operation of the main cam. Thirdly, the setting feedback (SF) system in the timer requires an additional "V"-shaped follower remaining in contact with a custom feel profile on the side of the main cam proximal the front housing; also, the steady contact between the "V"-shaped follower and the custom feel profile of the cam is not good in the cam driving state that it only causes friction, wearing of the components and resistance to the cam motion.

SUMMARY OF THE INVENTION

Accordingly, the present invention is a timer to solve the problems in the prior arts.

A timer provided in an embodiment of the present invention comprises a case, a cam wheel, a drive mechanism, a plurality of switch blades, and an off-contact lever disposed within the case. The case comprises a shaft. The shaft is rotatably and axially movably disposed in the case, and movable between a setting position and a driving position. The cam wheel is pivoted on the shaft. The cam wheel rotates together with the shaft when the shaft is located at the setting position. The off-contact lever is pivoted in the case and is connected to the shaft. When the shaft is located at the setting position, the off-contact lever presses the cam actuating portions of the switch blades, so as to separate the cam actuating portions from the cam tracks of the cam wheel; meanwhile, the shaft latches the cam wheel so that the user can freely rotate the cam wheel to any desired position. Because the off-contact lever has two journals pivoted on two holes formed on the case, and the journals are correspondent to the range of the cam actuating portions of the switch blades, the shaft can operate the off-contact lever in a balanced way without the problem of unbalanced bending in prior arts.

The cam wheel comprises a plurality of cam tracks on one side surface thereof, and a plurality of first ratchets and second ratchets annularly disposed on a circular rim thereof. The cam wheel separates from the shaft and rotates independently when the shaft is located at the driving position. The drive mechanism operates the first and second ratchets of the cam wheel and drives the cam wheel to rotate relatively to the shaft. Each switch blade comprises a plurality of cam actuating portions, and contacts one of the cam tracks. The cam actuating portions are actuated by a rotation motion of the cam wheel, so as to enable the corresponding switch blades to generate electrical connections/disconnections. Because the first ratchets and second ratchets leave apart from the cam at the setting position, the cam wheel can be bi-directionally rotated with the shaft by the user during the setting state; and there is no need of a clutch mechanism in the gear train. The circular rim of the cam wheel further includes a locating track to be contacted with a flexible end and generates a tactile and/or audible feedback to the user when setting. The flexible end is formed on an anti-reverse paw of the drive mechanism and will reduce its contact force to the locating track of the cam wheel during the cam driving state so as to reduce friction and wearing of the components. Moreover, the flexible end made along with the paw is simple in construction that does not require any additional tension or fixing component for assembly.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
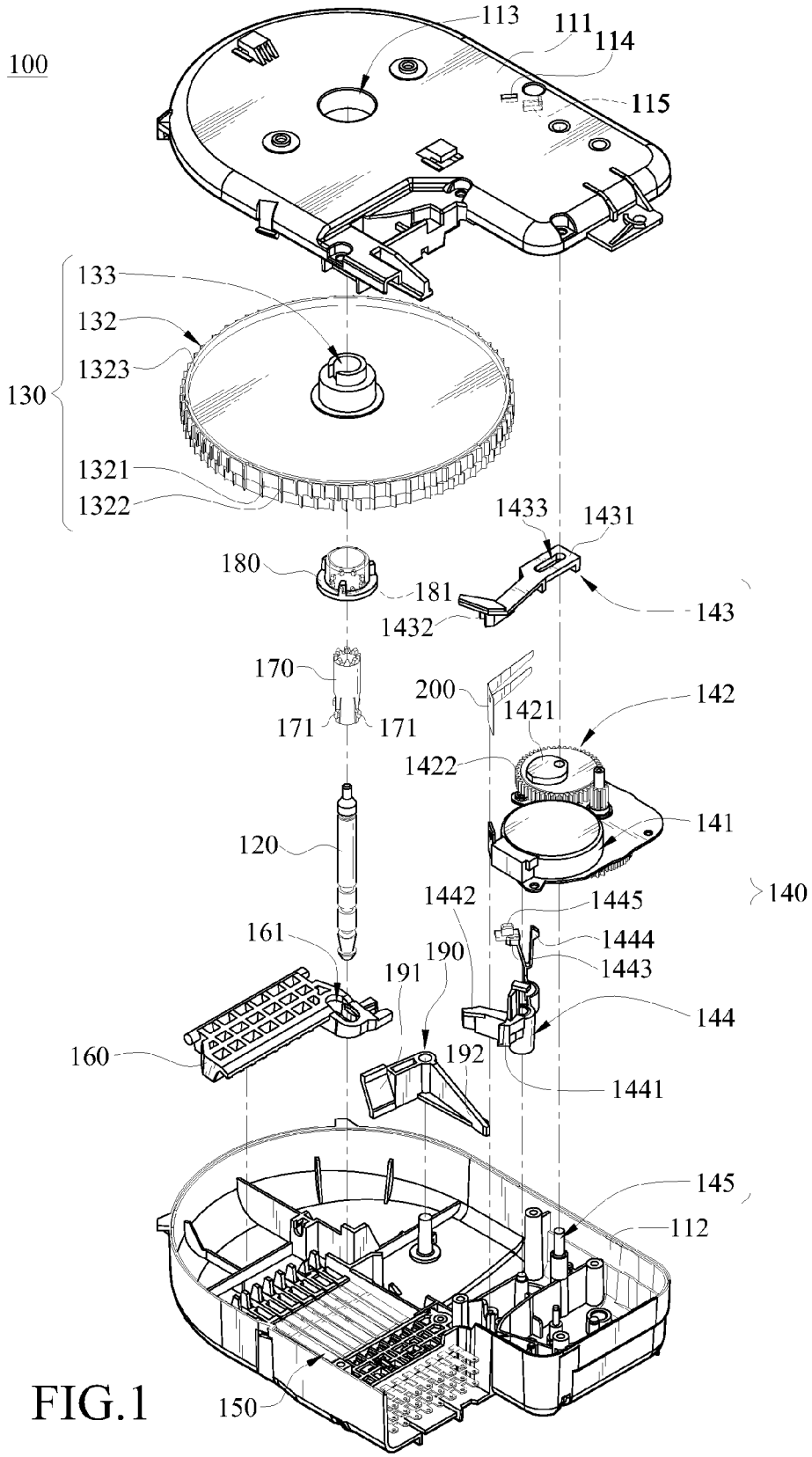
FIG. 1 is a schematic exploded view of an embodiment of the present invention.

The timer of the present invention is applicable to timer-operated household electrical appliances such as dish washers, washing machines or the like. The accompanying drawings are merely provided for reference and illustration, but not intended to limit the present invention.

Referring to FIGS. 1 to 6, a timer 100 according to the present invention comprises a case 110, a shaft 120, a cam wheel 130, a drive mechanism 140, a plurality of switch blades 150 and an off-contact lever 160.

The case 110 is formed by an upper case 111 and a lower case 112. Symmetric via holes 113 are opened on the upper case 111 and the lower case 112 respectively. The shaft 120 passes through the two via holes 113 of the upper case 111 and the lower case 112, and is thus disposed in the case 110. In addition, the shaft 120 is rotatable and axially movable relative to the case 110, such that the shaft 120 not only rotates about an axle center of itself, but also is reciprocally movable between a setting position and a driving position. A pair of wire springs 210 are further disposed on the lower case 112 of the case 110 at a position close to the via hole 113. The wire springs 210 are used for clamping the shaft 120 to maintain the shaft 120 at the setting position or the driving position, such that the shaft 120 cannot be easily detached from the preset position due to unintentional external forces.

Figure 6:
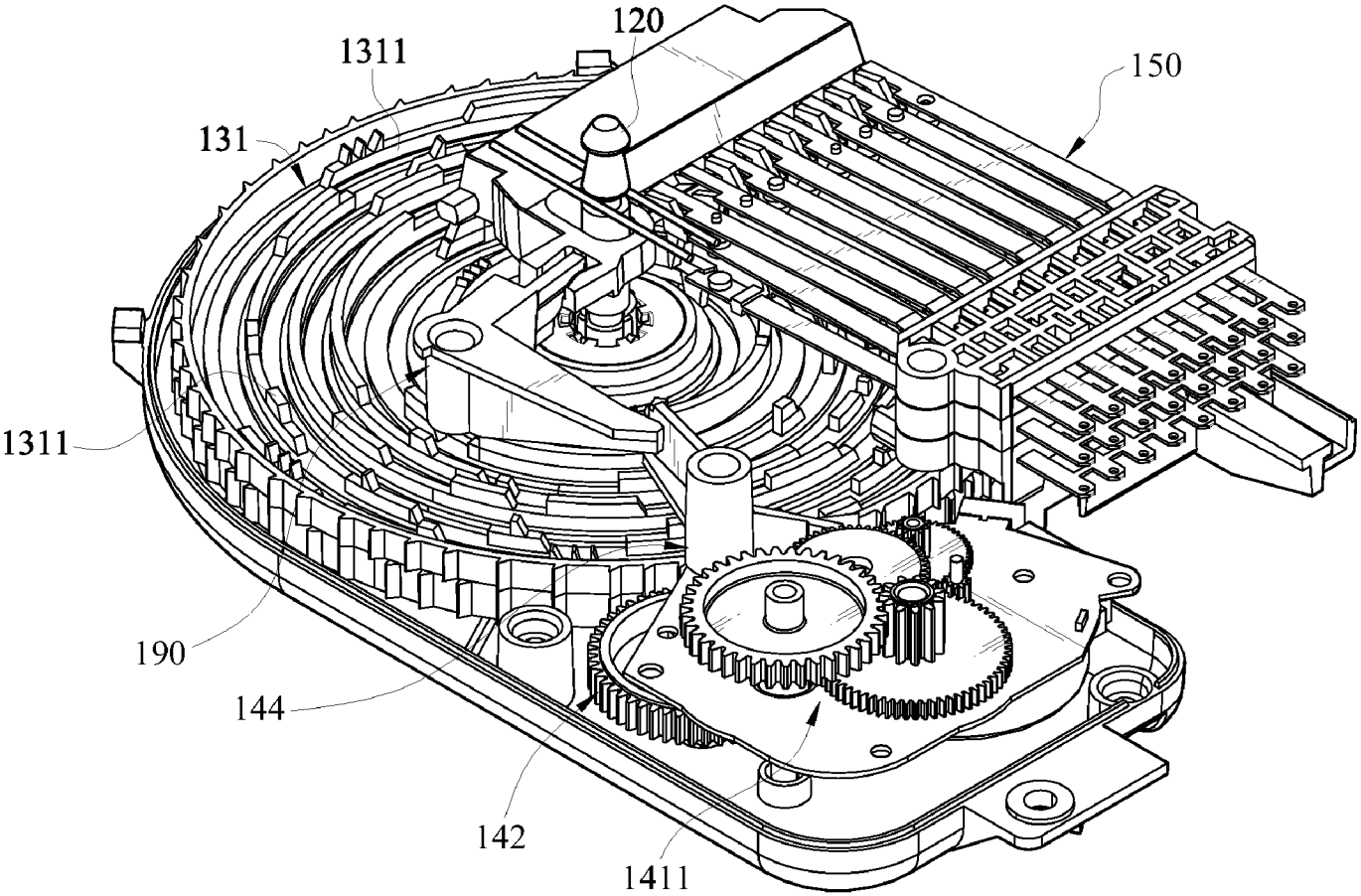
FIG. 6 is a further perspective view of FIG. 5 when removing the lower case.

Referring to FIGS. 1 and 6, an axle hole 133 is opened at a central position of the cam wheel 130, and is sleeved on the shaft 120, such that the cam wheel 130 is pivoted on the shaft 120. In addition, the cam wheel 130 comprises a plurality of cam tracks 1311 on a side surface 131 thereof (i.e., a lower surface of the cam wheel 130). A plurality of unevenly-spaced first ratchets 1321 protrudes from an upper portion of a circular rim 132 of the cam wheel 130, and a plurality of unevenly-spaced second ratchets 1322 protrudes from a lower portion of the circular rim 132 of the cam wheel 130.

In addition, the timer 100 of the present invention further comprises a sleeve 170 and a collar 180. The sleeve 170 is sleeved on the shaft 120, and the sleeve 170 comprises at least one first engaging tooth 171 on an outer edge thereof. The collar 180 is movably sleeved on the sleeve 170, and the collar 180 comprises at least one second engaging tooth 181 at an inner edge thereof, in which the second engaging tooth 181 matches with the first engaging tooth 171. The sleeve 170 and the collar 180 are latched together due to the engagement between the first engaging tooth 171 and the second engaging tooth 181 when the shaft 120 is at the setting position. The collar 180 is also engaged with the cam wheel 130 so that the sleeve 170 engaged with a knob (not shown) turned by the user during setting will rotate the cam wheel 130. On the contrary, the sleeve 170 and the collar 180 are free from engagement, and the knob is free from the cam wheel 130, when the shaft 120 is at the driving position.

Figure 2:
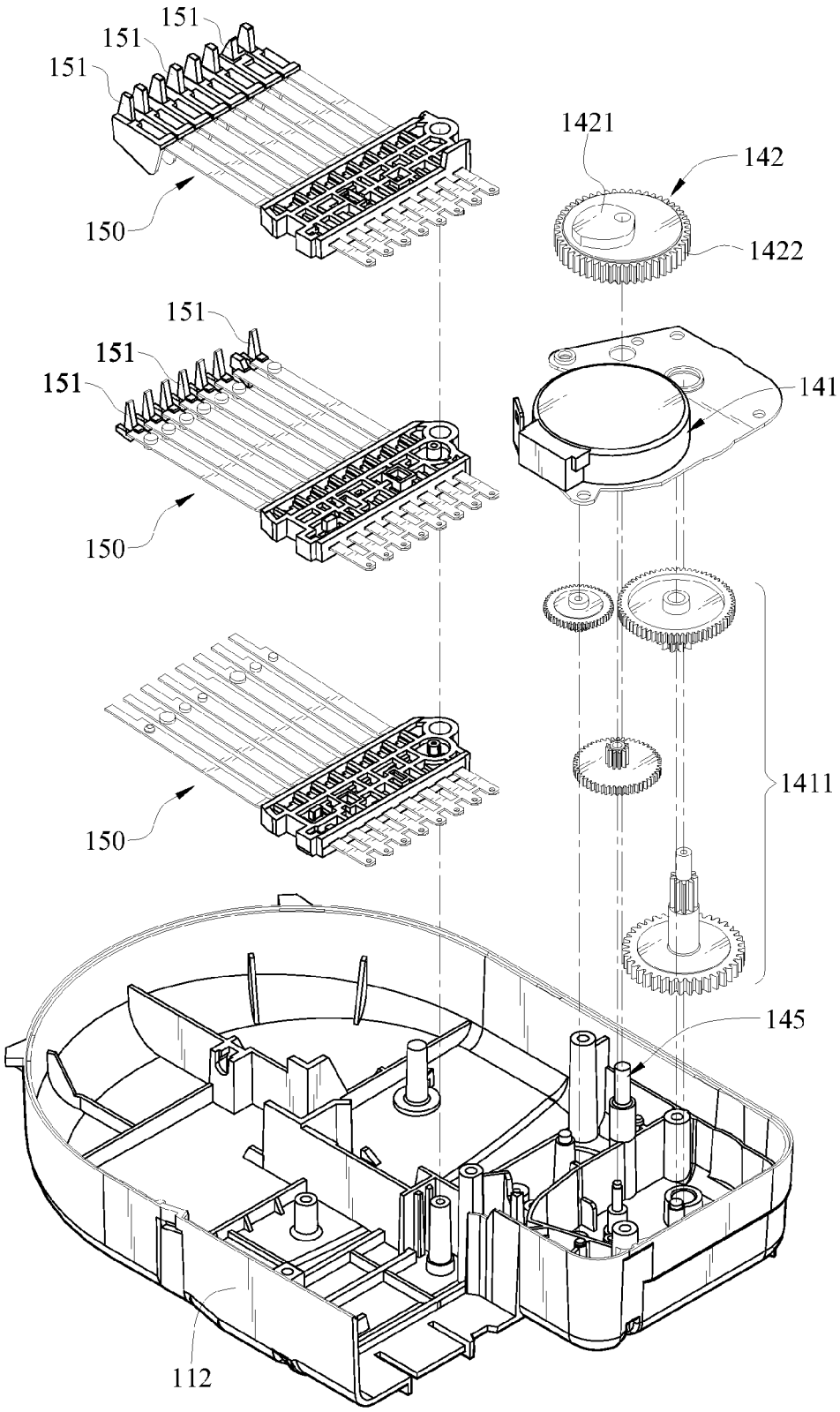
FIG. 2 is a schematic partially exploded view of an embodiment of the present invention showing mainly the switch blades and a part of drive mechanism.
Figure 3:
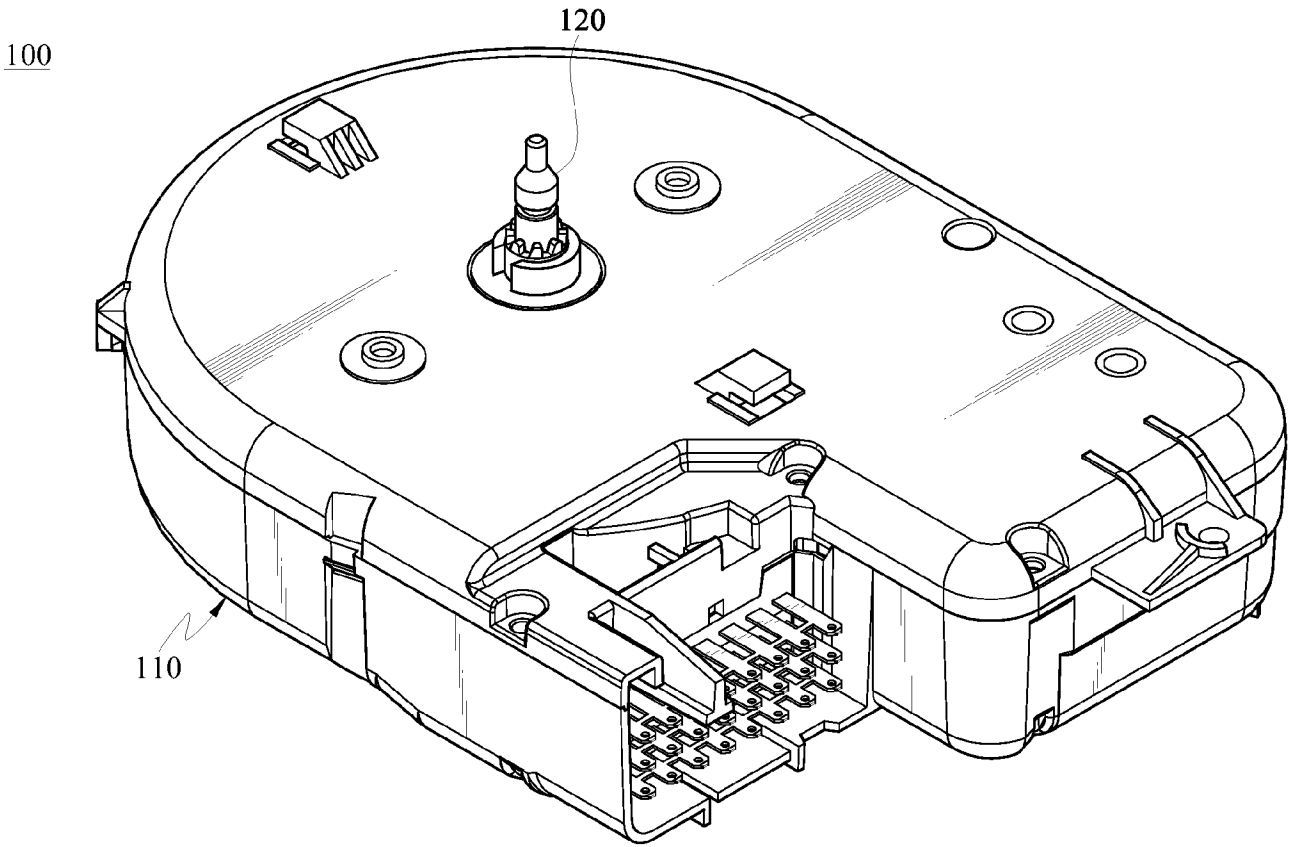
FIG. 3 is a top perspective view of an embodiment of the present invention.
Figure 4:
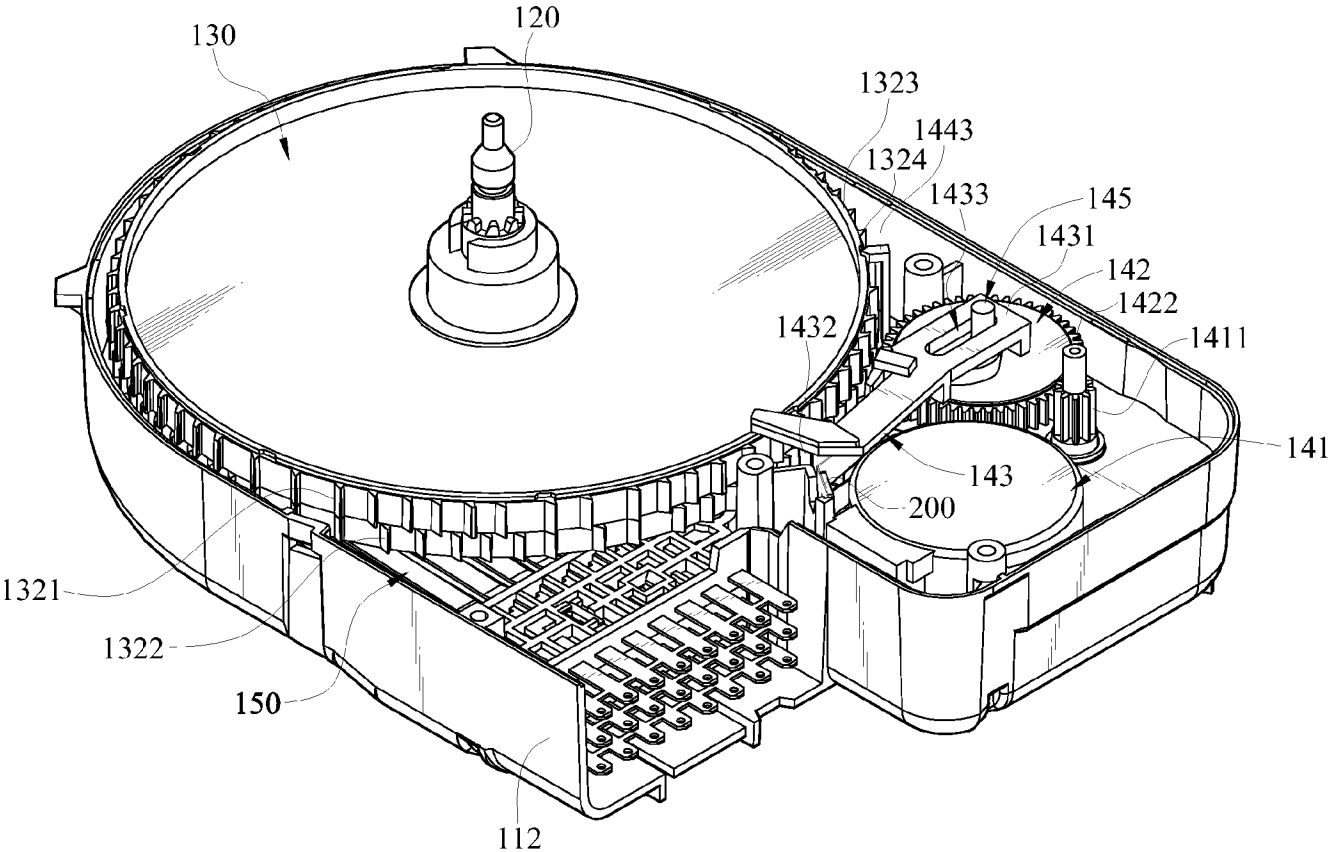
FIG. 4 is a further perspective view of FIG. 3 when removing the upper case.
Figure 5:
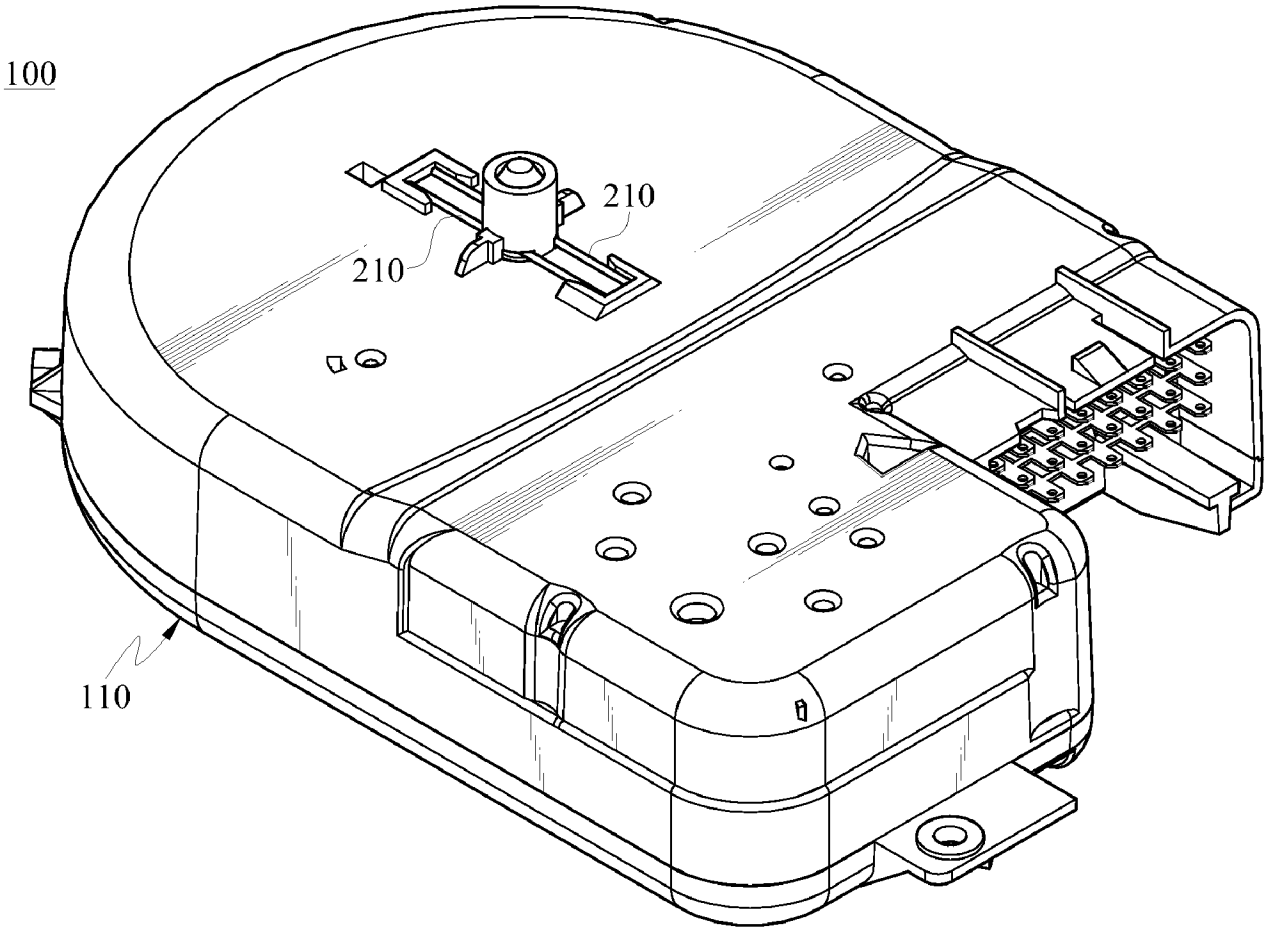
FIG. 5 is a bottom perspective view of an embodiment of the present invention.

Referring to FIGS. 1 and 2, the drive mechanism 140 in the present invention comprises a motor 141, a driving cam 142, a push paw 143, an anti-reverse paw 144, and an axle 145. The motor 141 comprises a gear train 1411. The driving cam 142 is mounted on the axle 145. The driving cam 142 comprises a cam block 1421 protruding from one side surface thereof, and a tooth 1422 annularly disposed on an outer edge thereof. The tooth 1422 is engaged with the gear train 1411 of the motor 141, such that the driving cam 142 is driven by the motor 141 to rotate relative to the axle 145. The push paw 143 comprises a connection end 1431 and a push end 1432 opposite to each other. The connection end 1431 is further opened with a slot 1433. The connection end 1431 of the push paw 143 is coupled with the cam block 1421 of the driving cam 142, and the slot 1433 is sleeved on the axle 145, and the push end 1432 of the push paw 143 contacts the first ratchets 1321 of the cam wheel 130. The push paw 143 is driven by the driving cam 142 to sway in a nonlinear displacement manner and pushes against the first ratchets 1321 by the push end 1432 thereof, such that the cam wheel 130 rotates relative to the shaft 120. The anti-reverse paw 144 is disposed in the case 110 in a pivoting manner, and the anti-reverse paw 144 comprises a rigid end 1441 and a pressed end 1442. The rigid end 1441 of the anti-reverse paw 144 selectively contacts the second ratchets 1322 of the cam wheel 130.

In addition, the present invention further comprises a plate spring 200 disposed in the case 110 and configured adjacent to the push paw 143 and the anti-reverse paw 144. The plate spring 200 is used for normally pushing the push paw 143 and the anti-reverse paw 144 to contact the first ratchets 1321 and the second ratchets 1322 of the cam wheel 130 respectively.

As shown in FIGS. 2 and 6, the plurality of switch blades 150 of the present invention comprises a plurality of cam actuating portions 151 respectively, and may selectively press against the cam tracks 1311 of the cam wheel 130. The cam actuating portions 151 are actuated by a rotation motion of the cam wheel 130, so as to enable the corresponding switch blades 150 to generate an electrical connection/disconnection, thus enabling the household electrical appliance (not shown) to perform a corresponding function. It should be noted that, three switch blades 150 are disclosed in this embodiment, and the three switch blades 150 are arranged in the case 110 at different heights. However, it is apparent to those skilled in the art that, the number of switch blades may also be increased or decreased according to actual operational requirements or design requirements, but is not limited to the number of the switch blades 150 disclosed in this embodiment.

As shown in FIG. 1, the off-contact lever 160 of the present invention is pivoted in the case 110, and may sway relative to the case 110 (111, 112), so as to selectively press against the cam actuating portions 151 (FIG. 2) of the switch blades 150. The off-contact lever 160 comprises a through hole 161 for mounting the shaft 120 therein, such that the off-contact lever 160 is connected to the shaft 120. The timer 100 of the present invention further comprises a paw lever 190 pivoted in the case 110. The paw lever 190 comprises a linking end 191 and a pressing end 192. The linking end 191 normally abuts against the off-contact lever 160, and the pressing end 192 is actuated by the off-contact lever 160 to selectively press against the pressed end 1442 of the anti-reverse paw 144.

Then, the operation of the timer 100 of the present invention is described in detail.

Figure 7:
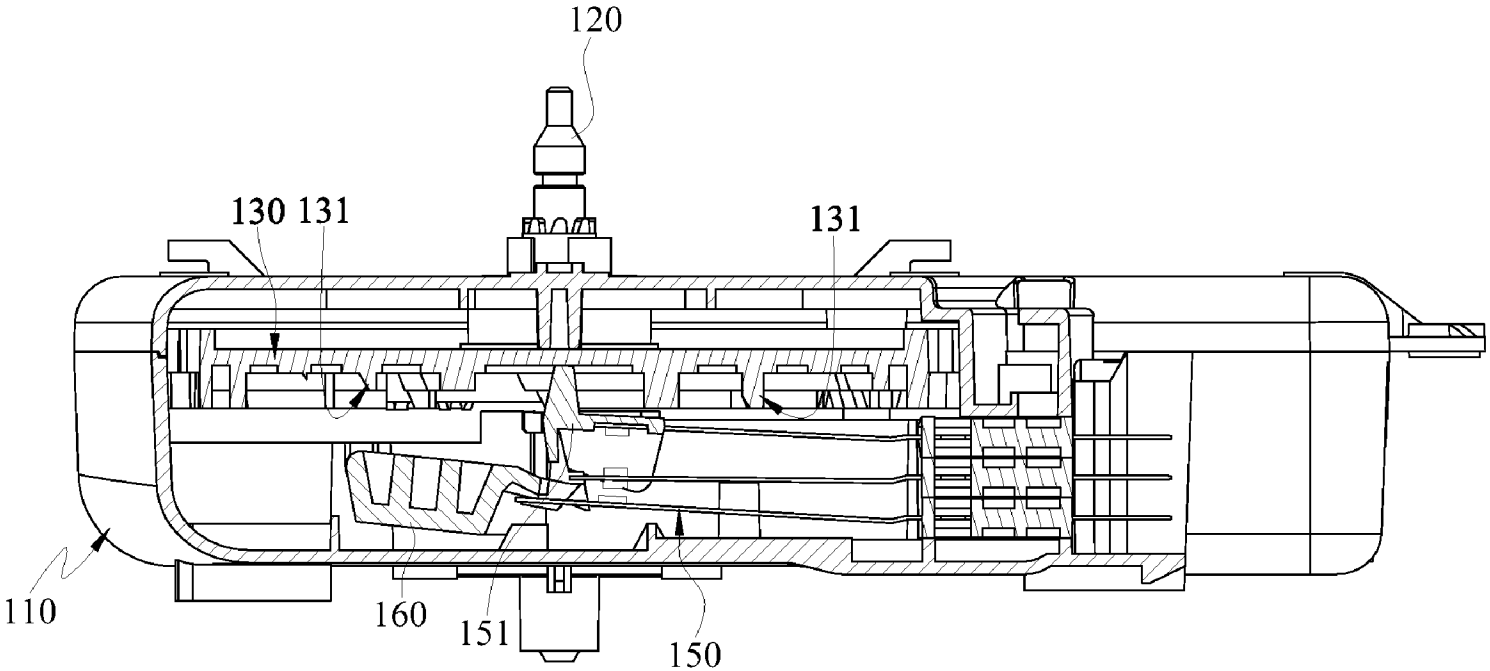
FIG. 7 is a cross-sectional side view of a timer according to the present invention where a shaft is located at a setting position.
Figure 8:
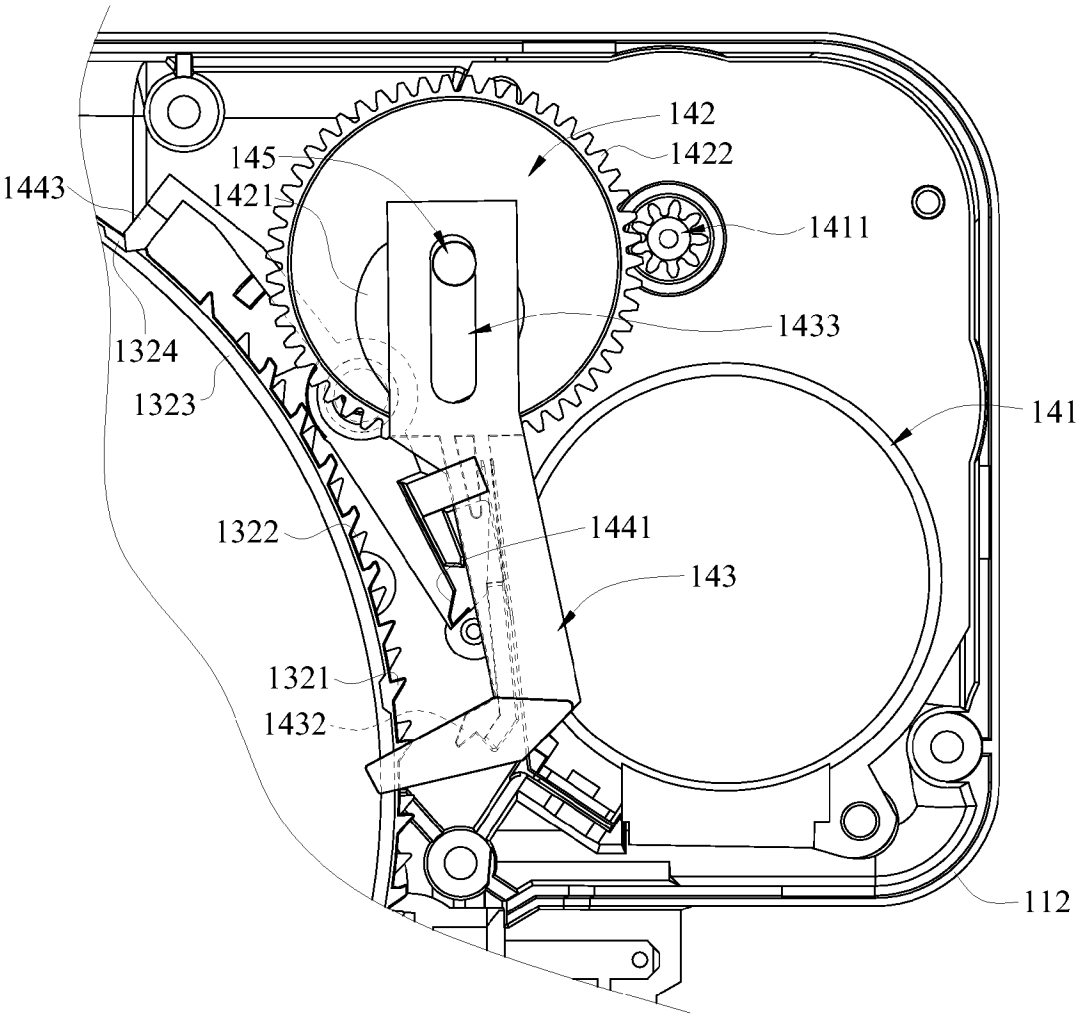
FIG. 8 is a partially-enlarged top view of a timer according to the present invention where the shaft is located at a setting position.
Figure 9:
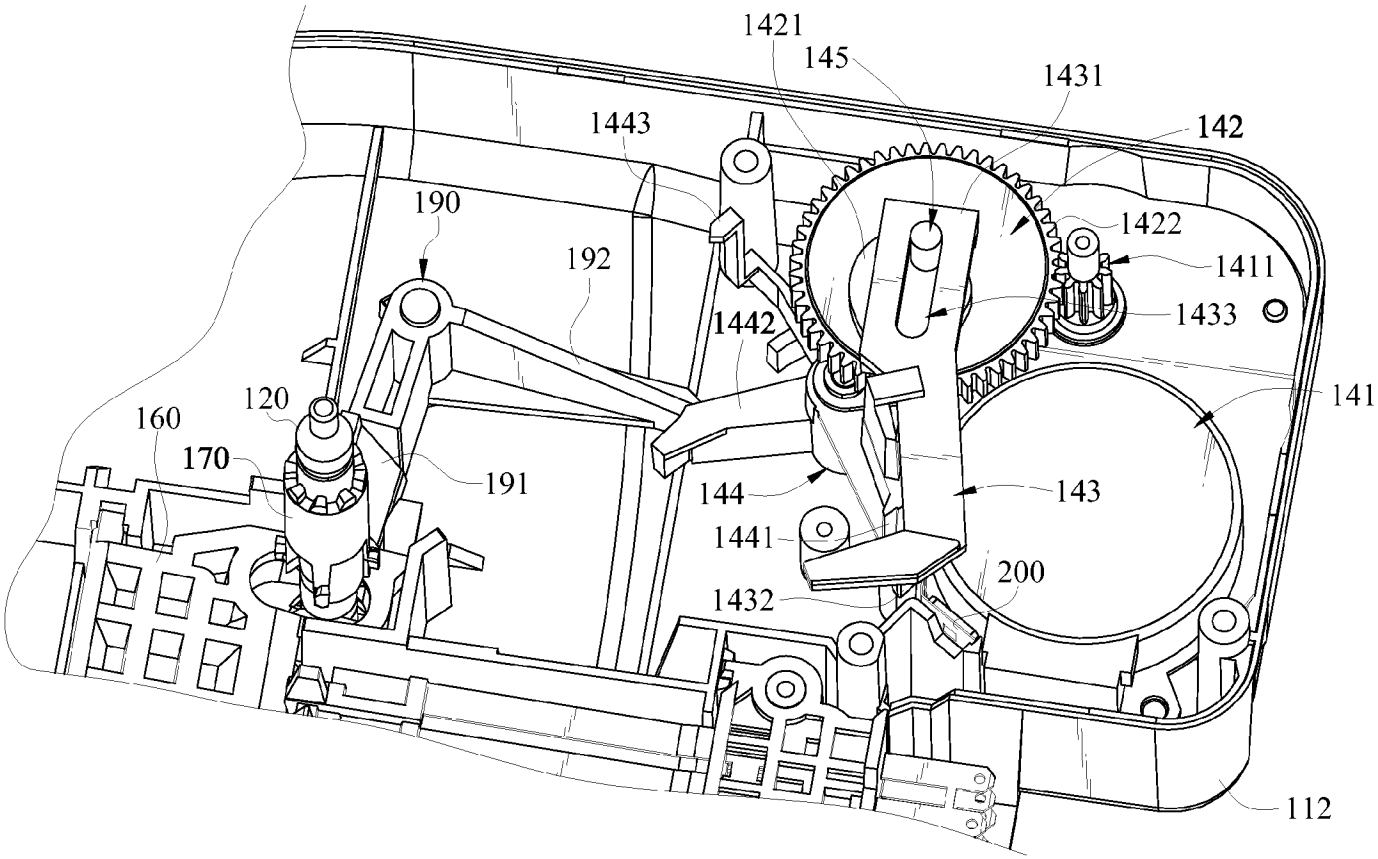
FIG. 9 is a partially-enlarged perspective view of the timer of FIG. 8 where the cam wheel is not shown.

Referring to FIGS. 7 to 9, when the shaft 120 is pressed down to the setting position, the sleeve 170 and the collar 180 (FIG. 1) are combined with each other through the engagement motion between the first engaging tooth 171 and the second engaging tooth 181, such that the cam wheel 130 may rotate together with the shaft 120. At this time, the shaft 120 pushes against the off-contact lever 160 to press downwards the cam actuating portions 151 of the switch blade 150 closest to the off-contact lever 160 (i.e., the cam actuating portions 151 of the lowest switch blade 150), such that contacts (not shown) of the switch blades 150 are not electrically connected, and thus, the user can set a state of the timer 100 by rotating the shaft 120 clockwise or anticlockwise. Meanwhile, the off-contact lever 160 is pressed to pivot and drives the linking end 191 of the paw lever 190, such that the paw lever 190 pivots along with the off-contact lever 160. At this time, the pressing end 192 of the paw lever 190 presses against the pressed end 1442 of the anti-reverse paw 144, such that the rigid end 1441 of the anti-reverse paw 144 separates from the second ratchets 1322 on the circular rim 132 of the cam wheel 130. Therefore, when the shaft 120 is located at the setting position, the user can freely rotate the cam wheel 130 clockwise or anticlockwise without being restricted by the rigid end 1441 of the anti-reverse paw 144.

Figure 10:
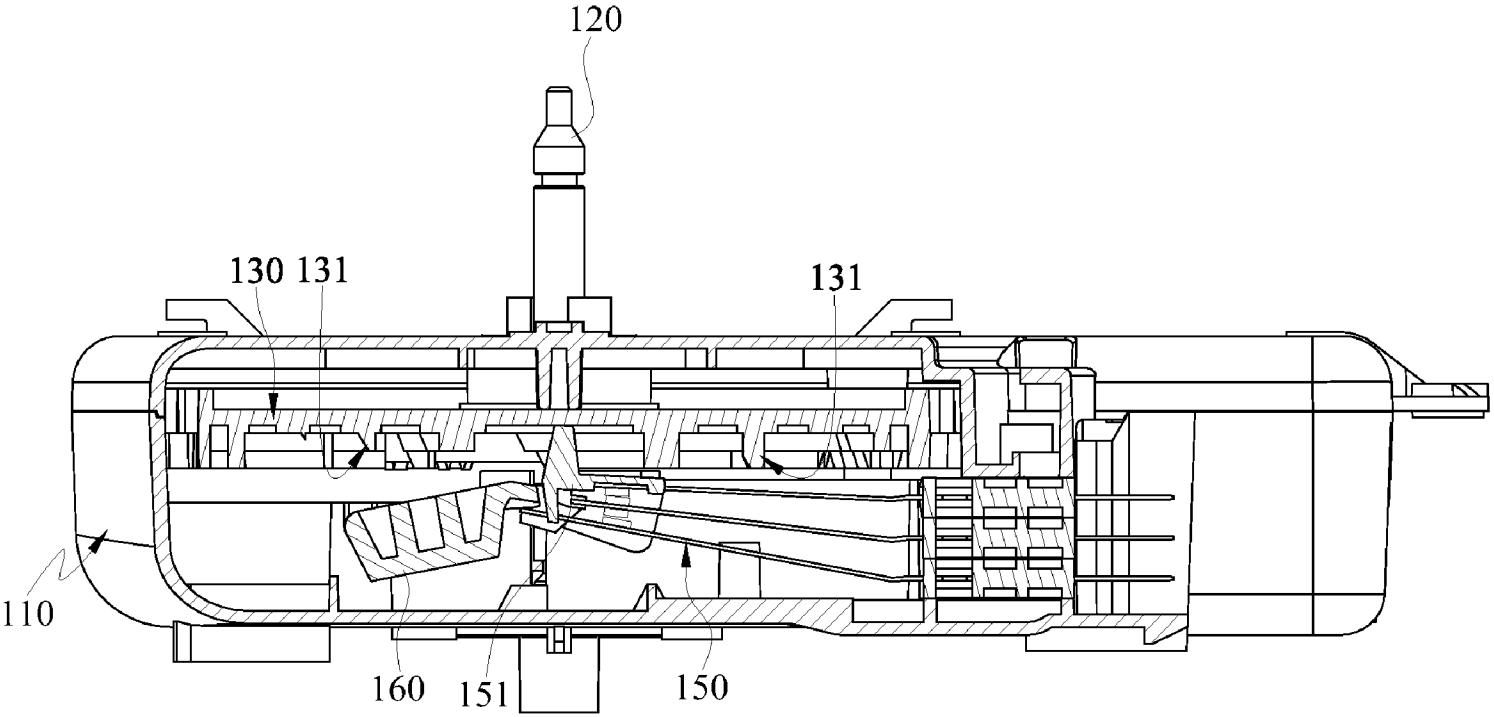
FIG. 10 is a cross-sectional side view of the timer according to the present invention where the shaft is located at a driving position.
Figure 11:
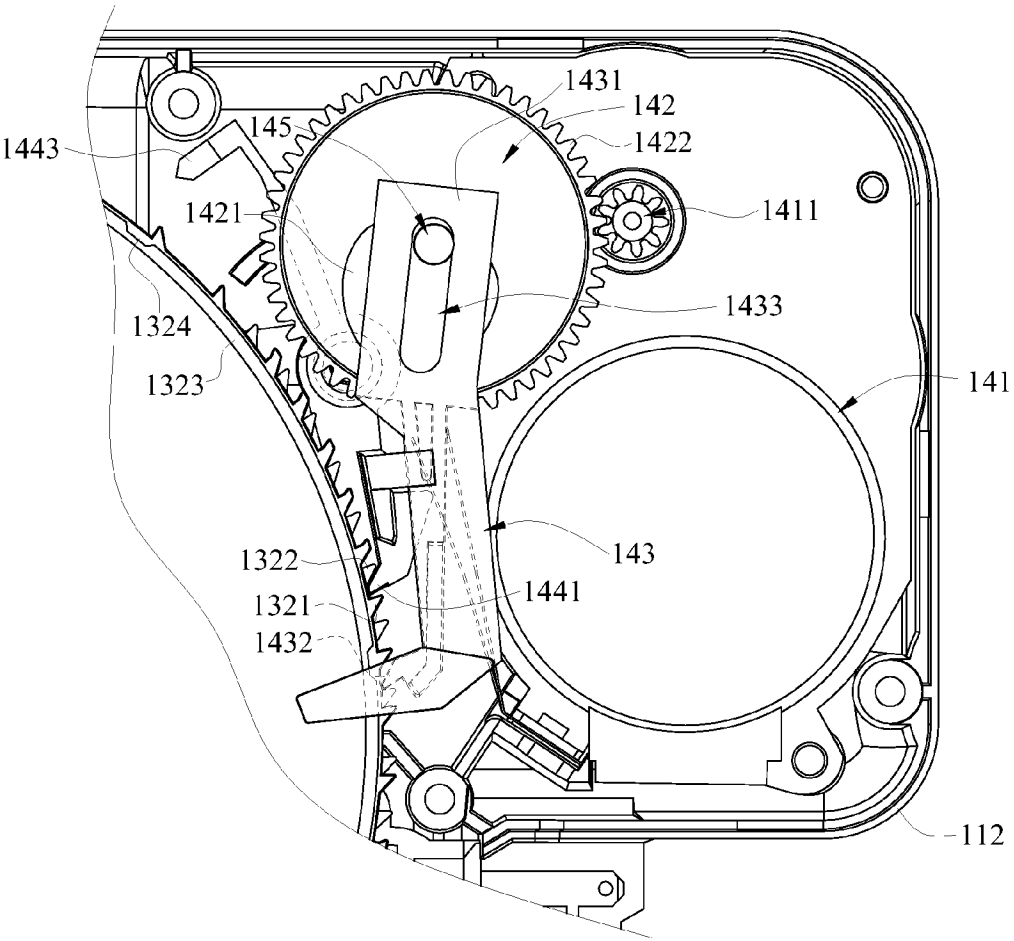
FIG. 11 is a partially-enlarged top view of a timer according to the present invention where the shaft is located at a driving position.
Figure 12:
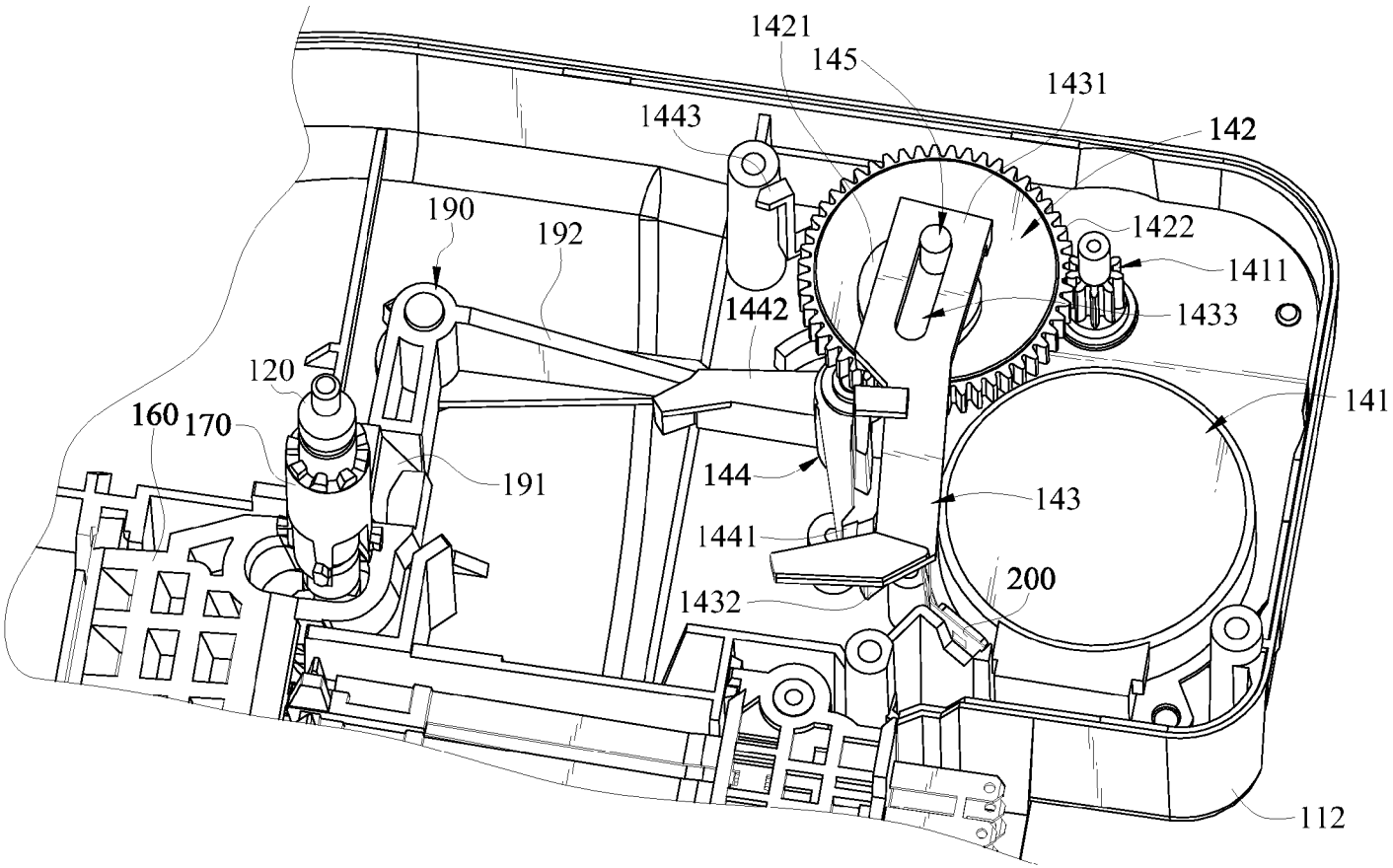
FIG. 12 is a partially-enlarged perspective view of the timer of FIG. 11 where the cam wheel is not shown.

Referring to FIGS. 10 to 12, when the shaft 120 is pulled upwards to the driving position, the first engaging tooth 171 of the sleeve 170 separates from the second engaging tooth 181 of the collar 180 (FIG. 1), such that the cam wheel 130 rotates independently without being driven by the shaft 120, and at this time, the user cannot rotate the cam wheel 130 correspondingly by turning the shaft 120. After the pressure exerted by the shaft 120 on the off-contact lever 160 is removed, the electrical connection/disconnection of the contacts (not shown) of the three switch blades 150 is not affected by the off-contact lever 160, and the cam actuating portions 151 of the switch blades 150 normally contact the cam tracks 1311 of the cam wheel 130. As the off-contact lever 160 is not pressed, the linking end 191 of the paw lever 190 connected to the off-contact lever 160 is not pressed and is not pivoted. At this time, the pressing end 192 of the paw lever 190 does not press the pressed end 1442 of the anti-reverse paw 144, and the plate spring 200 concurrently pushes the push paw 143 and the anti-reverse paw 144, so as to force the push end 1432 of the push paw 143 to contact the first ratchets 1321 on the circular rim 132 of the cam wheel 130, and force the rigid end 1441 of the anti-reverse paw 144 to contact the second ratchets 1322 on the circular rim 132 of the cam wheel 130. Therefore, when the shaft 120 is located at the driving position, the user cannot freely rotate the cam wheel 130 clockwise or anticlockwise, the cam wheel 130 is only pushed by the push paw 143 of the drive mechanism 140 to rotate towards a single direction, and the cam wheel 130 cannot rotate towards an opposite direction due to the restriction of the rigid end 1441 of the anti-reverse paw 144.

When the cam wheel 130 is actuated by the push end 1432 of the push paw 143 to rotate intermittently, the cam actuating portions 151 of the switch blades 150 that are designed as blade springs are deformed to different extents when contacting the cam tracks 1311 having different heights, so as to enable the switch blades 150 to generate an electrical connection/disconnection, thereby controlling the household electrical appliance (not shown) to perform a corresponding operation mode.

Referring again to FIGS. 9 and 8, when the shaft 120 is pressed down to the setting position, the sleeve 170 and the collar 180 (FIG. 1) are combined with each other through the engagement motion between the first engaging tooth 171 and the second engaging tooth 181, such that the cam wheel 130 may rotate together with the shaft 120. At this time, the shaft 120 pushes against the off-contact lever 160, and the off-contact lever 160 is pressed to pivot and drives the linking end 191 of the paw lever 190, such that the paw lever 190 pivots along with the off-contact lever 160. At this time, the pressing end 192 of the paw lever 190 presses against the pressed end 1442 of the anti-reverse paw 144, such that the rigid end 1441 of the anti-reverse paw 144 separates from the second ratchets 1322 on the circular rim 132 of the cam wheel 130, but the flexible end 1443 of the anti-reverse paw 144 contacts the locating grooves 1324 of the locating track 1323 of the cam wheel 130. Therefore, when the shaft 120 is located at the setting position and the user freely rotates the cam wheel 130 clockwise or anticlockwise, a tactile feedback is generated between the flexible end 1443 of the anti-reverse paw 144 and the locating grooves 1324 of the cam wheel 130. As the circular rim 132 of the cam wheel 130 has a large outer diameter, the tactile and audible feedback generated between the flexible end 1443 of the anti-reverse paw 144 and the locating grooves 1324 of the cam wheel 130 is quite obvious. As such, the user can clearly perceive the tactile feeling when rotating the cam wheel 130, and thus can set the timer 100 of the present invention to a correct mode more accurately. On the contrary, as shown in FIGS. 11 and 12, when the shaft 120 is pulled upwards to the driving position, the off-contact lever 160 is not pressed, the linking end 191 of the paw lever 190 connected to the off-contact lever 160 is not pressed and is not pivoted. At this time, the pressing end 192 of the paw lever 190 does not press the pressed end 1442 of the anti-reverse paw 144, and the plate spring 200 concurrently pushes the push paw 143 and the anti-reverse paw 144, so as to force the push end 1432 of the push paw 143 to contact the first ratchets 1321 on the circular rim 132 of the cam wheel 130, and force the rigid end 1441 of the anti-reverse paw 144 to contact the second ratchets 1322 on the circular rim 132 of the cam wheel 130. Meanwhile, the flexible end 1443 of the anti-reverse paw 144 is free from contacting the locating track 1323 of the cam wheel 130 so as to reduce friction and wearing of the components.

Figure 13:
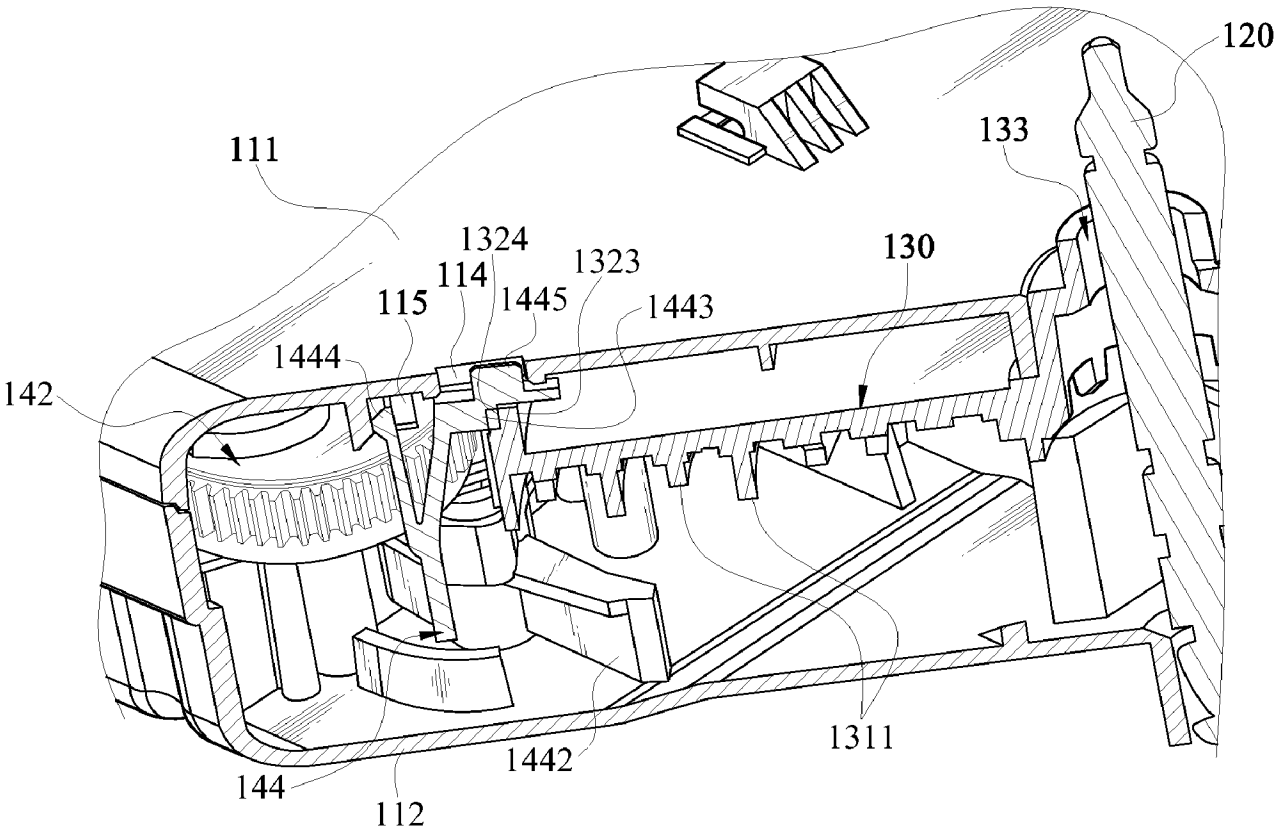
FIG. 13 is a cross-sectional side view of a timer according to the present invention showing mainly a tactile and/or audible feedback mechanism.
Figure 14:
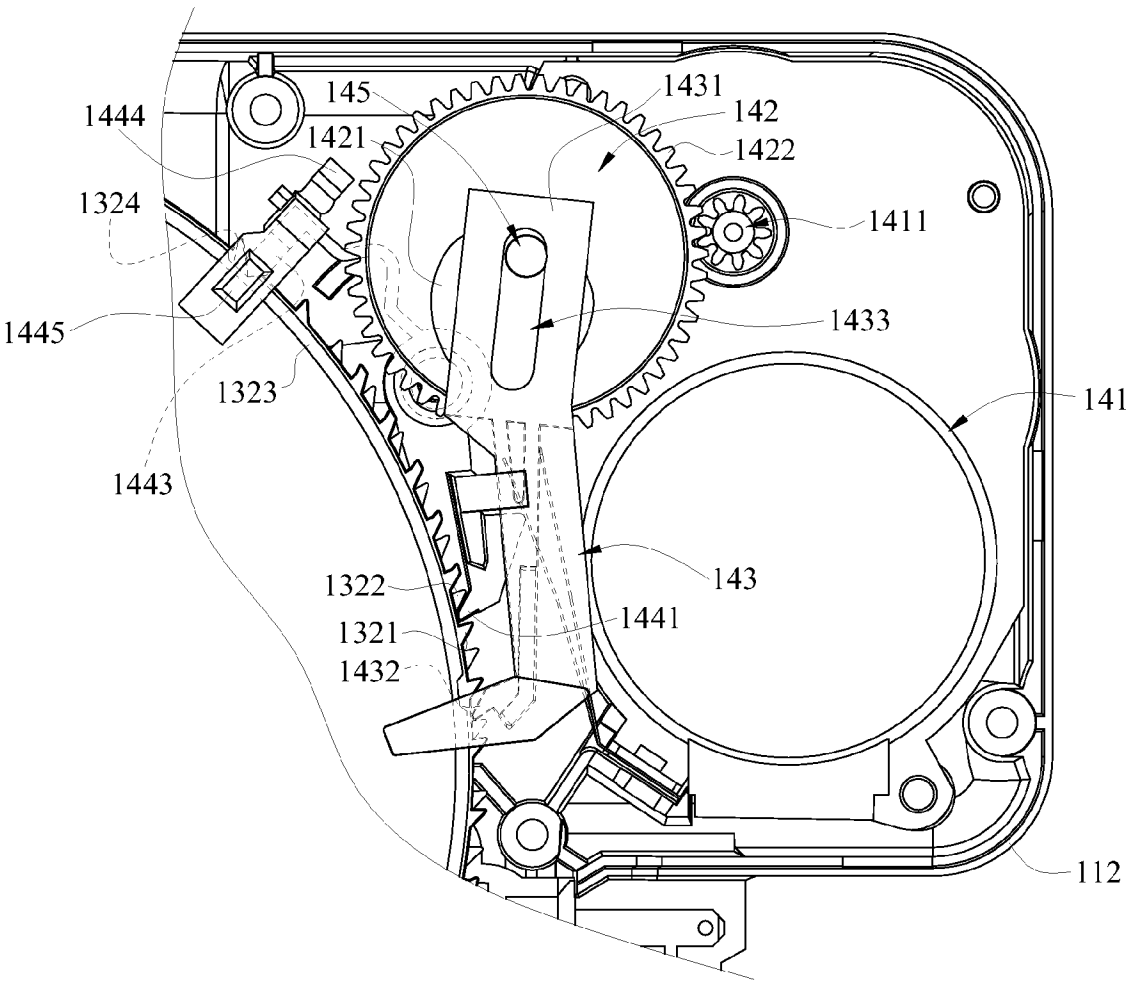
FIG. 14 is a partially-enlarged top view of the timer of FIG. 13.

FIGS. 13 and 14 illustrate a modification of the flexible end 1443 of the anti-reverse paw 144. The upper case 111 of the embodiment comprises a slot 114 and a rib 115. In addition to the rigid end 1441 and the pressed end 1442, the anti-reverse paw 144 further comprises a flexible end 1443 and a lean end 1444 extending on the other side thereof relative to the pressed end 1442. Wherein, the top surface of the flexible end 1443 has an embed block 1445. The embed block 1445 inserts into the slot 114 of the upper case 111 for guiding the movement of the flexible end 1443, and the lean end 1444 leans on the rib 115 to provide a suitable force to the flexible end 1443, such that the flexible end 1443 normally contacts the locating grooves 1324 of the locating track 1323 of the cam wheel 130. When the shaft 120 is pressed down to the setting position, the flexible end 1443 of the anti-reverse paw 144 swings toward the cam wheel 130 to provide a heavier contact to the locating track 1323 of the cam wheel 130 and to provide a clear tactile feedback. On the contrary, when the shaft 120 is pulled upwards to the driving position, the flexible end 1443 of the anti-reverse paw 144 swings away from the cam wheel 130 to reduce the contact force to locating track 1323 of the cam wheel 130 and to reduce the influence and friction to the timer driving.

As the first ratchet 1321, second ratchet 1322 and the locating track 1323 are designed on the large circular rim of the cam wheel 130, and work with the push paw 143 and the rigid end 1441 and flexible end 1442 of the anti-reverse paw 144 of the drive mechanism, it greatly improves the driving reliability and tactile feedback function of the timer. Moreover, the flexible end 1442 formed with the anti-reverse paw 144 is easy to be assembled without the need of any additional spring element for the tactile feedback function, and the cam wheel is easily manufactured, thus reducing the manufacturing difficulty and manufacturing cost.

What is claimed is:

1. A timer, comprising:

a case, comprising a shaft rotatably and axially movably disposed in the case, and the shaft is axially movable between a setting position and a driving position;

a cam wheel, pivoted on the shaft, wherein the cam wheel comprises a plurality of cam tracks on at least one side surface thereof and a plurality of first ratchets annularly disposed on a circular rim thereof; the cam wheel rotates along with the shaft when the shaft is located at the setting position; and the cam wheel separates from the shaft when the shaft is located at the driving position;

a drive mechanism, selectively contacting the first ratchets of the cam wheel, for driving the cam wheel to rotate relative to the shaft;

a plurality of switch blades, each comprising a plurality of cam actuating portions respectively, the cam actuating portions are actuated by a rotation motion of the cam wheel, so as to enable the corresponding switch blades to generate an electrical connection/disconnection; and an off-contact lever, pivoted in the case, and connected to the shaft;

wherein when the shaft is located at the setting position, the off-contact lever presses at least a portion of the switch blades to free the cam actuating portions of the switch blades from the cam tracks of the cam wheel, and to move the drive mechanism away from contacting the cam wheel; and when the shaft is located at the driving position, the off-contact lever frees the cam actuating portions of the switch blades to contact the cam tracks of the cam wheel, and let the drive mechanism drive the cam wheel.

2. The timer according to claim 1, further comprising: a sleeve and a collar, wherein the sleeve is sleeved on the shaft, the collar is sleeved on the sleeve, the sleeve is engaged with the collar and drives the shaft to rotate together with the cam wheel when the shaft is located at the setting position, and the sleeve separates from the collar when the shaft is located at the driving position.

3. The timer according to claim 2, wherein the sleeve comprises at least one first engaging tooth on an outer edge thereof, the collar comprises at least one second engaging tooth at an inner edge thereof, and the second engaging tooth matches and is engaged with the first engaging tooth.

4. The timer according to claim 1, wherein the drive mechanism comprises a motor, a driving cam, a push paw, and an anti-reverse paw; a plurality of second ratchets is annularly disposed on the circular rim of the cam wheel; the driving cam is engaged with the motor; the push paw is movably disposed on the driving cam and contacts the first ratchets of the cam wheel; the push paw pushes the cam wheel to rotate relative to the shaft when the motor drives the driving cam; and the anti-reverse paw selectively contacts the second ratchets of the cam wheel in a pivoting manner.

5. The timer according to claim 4, wherein the drive mechanism further comprises an axle formed on the case; the driving cam is mounted on the axle and is driven by the motor to rotate relative to the axle; the driving cam comprises a cam block on one side surface thereof; the push paw comprises a connection end and a push end; the push end contacts the first ratchets of the cam wheel; the connection end is embedded with the cam block, and the connection end comprises a slot and is sleeved on the axle; and the push paw is driven by the driving cam to sway along with the driving cam and pushes the cam wheel to rotate by the push end thereof.

6. The timer according to claim 4, further comprising a paw lever pivoted in the case, wherein the paw lever comprises a linking end and a pressing end; the anti-reverse paw comprises a rigid end and a pressed end; the linking end of the paw lever abuts against the off-contact lever; when the shaft is located at the setting position, the pressing end of the paw lever presses against the pressed end of the anti-reverse paw, so as to enable the rigid end of the anti-reverse paw to separate from the second ratchets of the cam wheel; and when the shaft is located at the driving position, the pressing end of the paw lever separates from the pressed end of the anti-reverse paw, so as to enable the rigid end of the anti-reverse paw to contact the second ratchets of the cam wheel.

7. The timer according to claim 4, wherein the cam wheel further comprises a locating track on the circular rim thereof; the locating track comprises a plurality of locating grooves; the anti-reverse paw further comprises a flexible end selectively contacting one of the locating grooves of the cam wheel; when the shaft is located at the setting position, the pressing end of the paw lever presses against the pressed end of the anti-reverse paw, so as to enable the flexible end of the anti-reverse paw to contact one of the locating grooves of the cam wheel to provide a tactile feedback; and when the shaft is located at the driving position, the pressing end of the paw lever separates from the pressed end of the anti-reverse paw, so as to enable the flexible end of the anti-reverse paw to separate from the locating groove of the cam wheel.

8. The timer according to claim 7, wherein the flexible end further comprises an embed block and a lean end; the case is further formed with a slot to receive the embed block and guide the movement of the flexible end, and the lean end provides a suitable force to the flexible end so that the flexible end contacts the locating grooves of the locating track of the cam wheel to provide a tactile feedback when the shaft is pressed down to the setting position and the cam wheel is rotated for setting.

9. The timer according to claim 4, further comprising a plate spring disposed in the case, wherein the plate spring normally pushes the push paw and the anti-reverse paw to contact the first ratchets and the second ratchets of the cam wheel respectively.

* * * * *